United States Patent [19]

Miller

[11] Patent Number: 5,016,557

[45] Date of Patent: May 21, 1991

[54] MODULAR ROWING SHELL

[76] Inventor: William J. Miller, 309 Washington St., Duxbury, Mass. 02332

[21] Appl. No.: 446,656

[22] Filed: Dec. 6, 1989

[51] Int. Cl.[5] ..... B63B 35/00/35/71

[52] U.S. Cl. ..... 114/347; 114/352

[58] Field of Search ..... 114/352, 347, 363; 440/105, 104; 416/70 R, 74

[56] References Cited

U.S. PATENT DOCUMENTS

| | | | |
|---|---|---|---|
| 1,223,512 | 5/1916 | Neville | 440/105 |
| 2,666,933 | 1/1954 | Engenserger | 114/352 |
| 3,740,781 | 6/1973 | Lau | 114/352 |
| 3,744,071 | 7/1973 | Bossler, Jr. | 114/354 |
| 3,748,670 | 7/1973 | Musson | 114/363 |
| 3,816,865 | 6/1974 | Ragan | 114/352 |
| 4,516,941 | 5/1985 | Reid | 114/347 |
| 4,649,852 | 3/1987 | Piantedosi | 114/347 |

*Primary Examiner*—Ed Swinehart

[57] ABSTRACT

A modular sliding-seat rowing shell that is relatively inexpensive and that can be constructed to provide any of three rowing configurations. The shell includes a bow section, a stern section and a center section. The bow and stern sections have the same number (e.g., 2) of rowing stations, and the center section has twice as many (e.g., 4) rowing stations. At each of the rowing stations in all of the sections the beam of the shell is the same (e.g. 22 inches), and the sections are designed and constructed such that the bow section and the stern section may be connected directly to each other to form a shell having one conventional rowing configuration (e.g., a four-oared shell), and the central section can be connected between the bow and stern sections to form a shell having a second conventional rowing configuration (e.g., an eight-oared shell). Two eight-oared configurations may be joined by two jokes to form a shell having a third conventional rowing configuration (e.g., a sixteen-oared training shell).

15 Claims, 3 Drawing Sheets

MODULAR ROWING SHELL

FIELD OF INVENTION

This invention relates to sliding-seat rowing shells and, more particularly, to shells having a modular construction in which the modules may be assembled to provide any of three shell configurations.

BACKGROUND OF INVENTION

There are a number of different types of sliding-seat rowing shells. Principal types are four-oared and eight-oared shells with coxswain, in which each rower pulls a single oar. Successive rowers pull oars that, typically, are on opposite sides of the shell. Such shells are expensive, and it has been necessary for competitors in both four- and eight-oared events to possess shells of each configuration. A third type of sliding-seat rowing shell is a training shell, a wide, stable design where beginners can learn how to row.

A number of U.S. Pat. Nos. 43,084, 520,823, 544,676, 670,942, 842,349, 957,820, 1,127,842, 1,258,745, 1,337,781, 1,449,222, 2,406,085, 2,741,782, 3,348,246, and 3,965,513, disclose boats that can be taken apart for storage or transportation, and then reassembled in a predetermined single configuration for use. U.S. Pat. No. 697,539 discloses a three-section boat the pieces of which may be assembled either as an ordinary-shaped boat or as a catamaran. U.S. Pat. No. 2,666,933 discloses a multi-section boat in which between eight and fourteen sections may be connected together to form a boat for one to four persons. An approximately 100 foot long "dragon boat" made up from various sectional components is shown in U.S. Pat. No. 3,740,781. A ten-man training shell at the University of Washington was constructed by cutting a conventional eight-oared shell in half and inserting a short center section so that ten rowers could practice at once.

SUMMARY OF THE INVENTION

The present invention provides a modular rowing shell that is relatively inexpensive and that can be constructed to provide any of three rowing configurations. In its preferred embodiment, the rowing shell of the invention includes a bow section, a stern section and a center section, and, for training shells, a pair of connecting yokes. The bow and stern sections have the same number (e.g., 2) of rowing stations, and the center section has twice as many (e.g., 4) rowing stations. At each of the rowing stations in all of the sections, the beam of the shell is the same, and the sections are designed and constructed such that the bow section and the stern section may be connected directly to each other to form a shell having one conventional rowing configuration (e.g., a four-oared shell), the center section can be connected between the bow and stern sections to form a shell having a second conventional rowing configuration (e.g., an eight-oared shell), and two-eight oared configurations can be fitted together with the pair of connecting yokes to form a sixteen-oared training shell.

In the preferred embodiments in which the stern section includes a coxswain seat and each rowing station includes a sliding seat assembly and an outrigger which pivotally supports an oar, all the port outriggers are identical, all the starboard outriggers are identical, the rowing station framing assemblies (i.e., the seat deck, knees, keel and keelson) at all of the rowing stations are the same, and the sides of the shell are parallel to each other throughout the length of the shell extending from the aft-most outrigger to the forward-most outrigger.

Other objects, features and advantages will appear from the following detailed description of a preferred embodiment of the invention.

DESCRIPTION OF PREFERRED EMBODIMENT

Figure 1A:
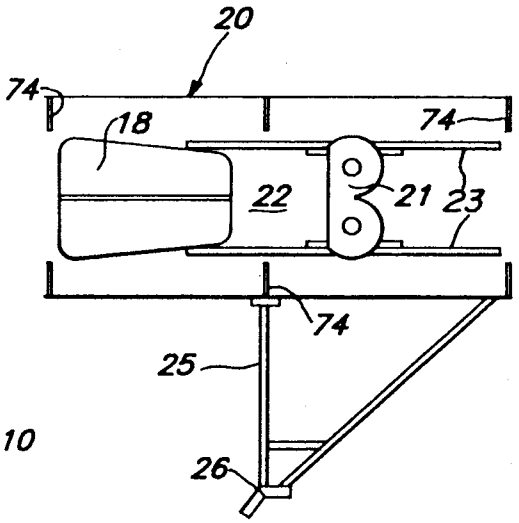
FIG. 1A is an enlarged view of a portion of FIG. 1.
Figure 1:
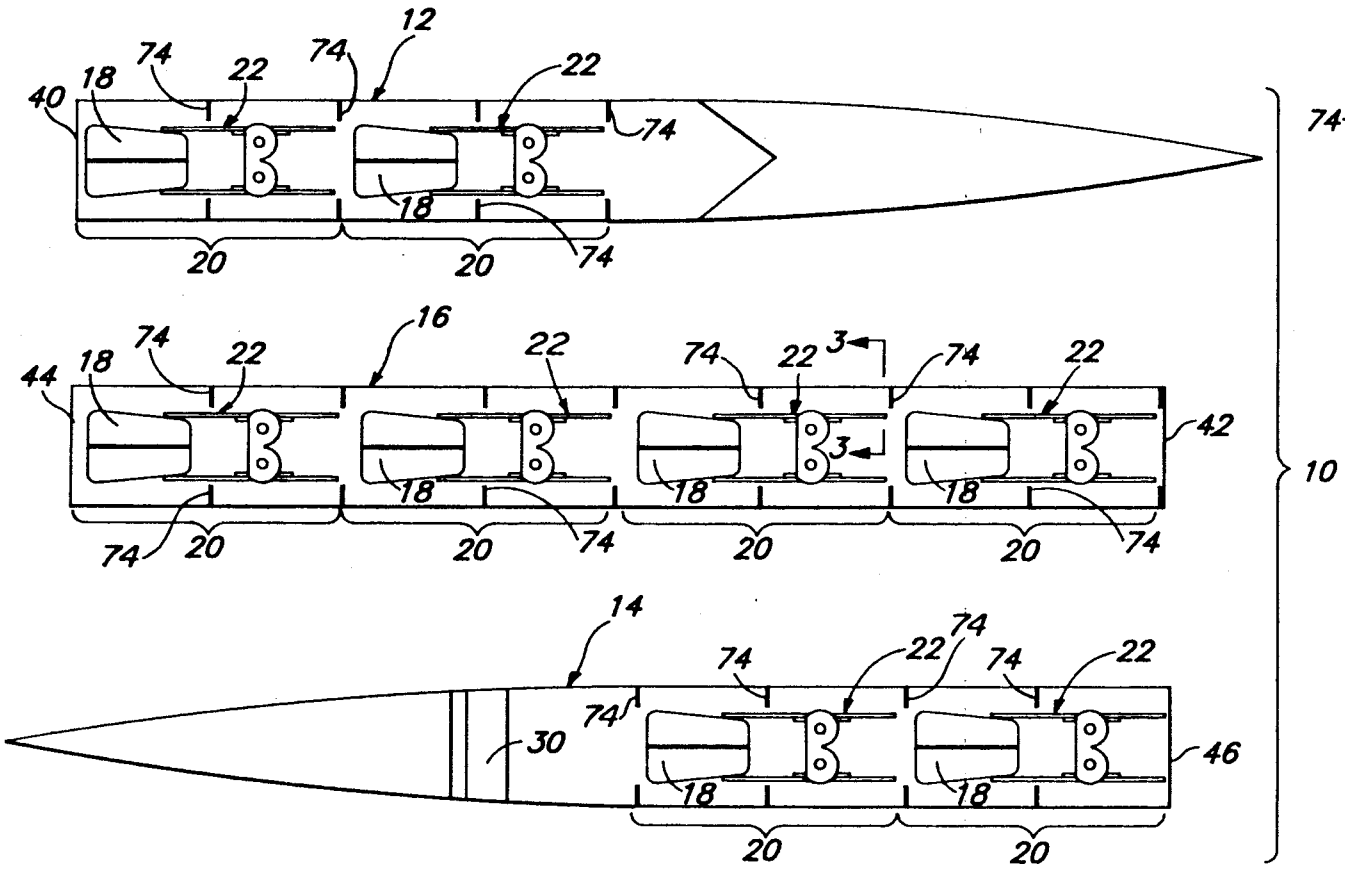
FIG. 1 is a plan view of the three sections of the modular shell of the present invention, with the outriggers removed.

Referring now to the drawings, FIGS. 1–4 show a modular shell, generally designated 10, including a bow section 12, a stern section 14 and a center section 16. The overall shell is about 55 feet long and has a beam of 22 inches. The bow and stern sections are each approximately 19 feet long; the center section is approximately 17 feet long.

As shown, shell 10 includes eight rowing stations, generally designated 20. Each rowing station includes a foot rest 18, a sliding seat assembly 22 and either a starboard outrigger 24 or a port outrigger 25. The construction of the foot rests and seat assemblies is conventional and forms no part of the present invention. As in conventional shells, each seat assembly 22 includes a seat 21 for the rower mounted on a pair of tracks 23 which permits the seat to move fore and aft. As in conventional shells, each outrigger 24, 25 is attached to the side of the shell (at, e.g., bolt holes 6 in FIG. 3) and supports an oarlock to receive propulsive forces and for pivotal movement about a generally vertical axis 26.

Bow section 12 includes two rowing stations 20. From the point at which the bow-most outrigger 24, 25 is attached to the bow section (i.e., adjacent the knee 74 at the forward end of the bow-most rowing station 20) to the aft-most portion of the bow section 12, the sides of the bow section are straight and parallel (viewed from above) and spaced 22 inches apart, and the draft of the shell section is constant. The forward portion of the bow section, i.e., from the point of attachment of the bow-most outrigger 24, 25 to the bow of the shell, is tapered.

Center section 16 includes four rowing stations 20. The sides of the center section are straight and parallel and spaced 22 inches apart, and the cross-section of the hull 8 (see FIG. 3) is constant, throughout.

Stern section 14 includes two rowing stations 20 and a coxswain's seat 30. As shown, the stern section is tapered from the aft-most point of attachment of an outrigger 24, 25 (i.e., from the knee 74 just forward of the coxswain seat 30) to the stern. From the aft-most point of attachment of an outrigger 24, 25 to the point at which section 14 is joined to the center section 16, the sides of the stern section are straight and parallel, and spaced 22 inches apart, and the shell section has a constant draft.

Thus, it will be seen that, in either a four-oared (FIG. 5) or an eight-oared (FIG. 4) configuration, the shell's beam and draft are constant, throughout the rowing stations; and the hull 8 of the center section 16 used in the eight-oared configuration also has a constant cross-section. As explained below, this provides significant advantages and economies.

In conventional shells, the beam of the shell constantly changes along the shell's length, reaching its maximum width at approximately midway over the length of the shell, and the draft of the shell also changes, being greater near the center of the shell than nearer the bow or stern. Because of these variations, the outriggers of conventional shell must be of different overall sizes so that the distances from the center line of the shell to each oarlock are all the same. Similarly, in conventional shells the width of the seat deck varies along the length of the shell, as does the height of the keelson and the size and shape of the knees.

Figure 3:
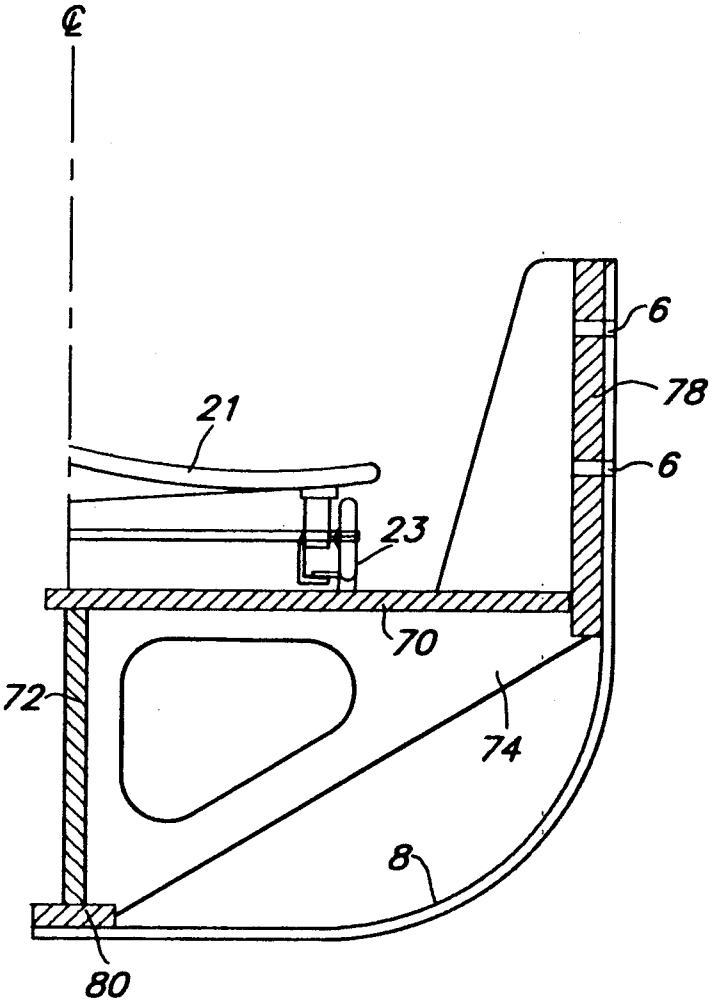
FIG. 3 is a sectional view taken at line 3—3 of FIG. 1.

According to the present invention, the shell is of constant beam and draft throughout the length of the rowing stations; and the rowing station framing assemblies, which in conventional shells vary in size and shape along the length of the shell, are also of constant and substantially identical construction. With particular reference to FIG. 3, the width (side-to-side of the shell) of the seat deck 70 is constant throughout the constant beam portion of the shell, the keelson 72 is of constant vertical height throughout the length of the rowing stations, and the knees 74 at the different rowing stations are also identical. The knee 74 of each framing assembly passes through a slot in the seat deck 70 and is attached to the shell gunwale 78 and to the keel 80 and keelson 72. Also, the outriggers on each side of the shell are all identical. The distance from the shell center line to the side of the shell is 11 inches, and that from the side of the shell to the substantially vertical axis of the oarlock of each outrigger is approximately 22 inches, thus producing a constant dimension of 33 inches from the center line of the shell to the substantially vertical axis of the oarlock.

Figure 5:
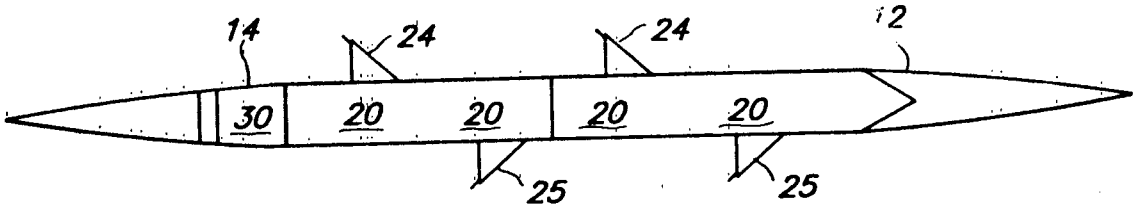
FIG. 5 is a plan of the bow and stern sections connected together to form a four-oared shell.

Generally C-shaped connectors 40, 42, 44 and 46 (connector 42 is shown most clearly in FIG. 2), are provided at, respectively, the aft end of the bow section 12, the forward and aft ends of the center section 10, and the forward end of stern section 14. The connectors 40, 42, 44 and 46 are identical. Each is securely fixed to the inside of the hull, keel and gunwale of a respective shell section and is perpendicular to center line of the shell. One transverse side of each connector is flush with an end of the shell section, and ten bolt holes 50 extend through each connector. When stern section 14 and bow section 12 are connected together to form a four-oared shell (as shown in FIG. 5), or all three sections 12, 14 and 10 are connected together to form an eight-oared shell (as shown in FIG. 4), the connectors at the ends of adjacent shell sections abut each other and each pair of adjacent shell sections is held together by ten stainless steel bolts which extend through bolt holes 50.

Figure 6:
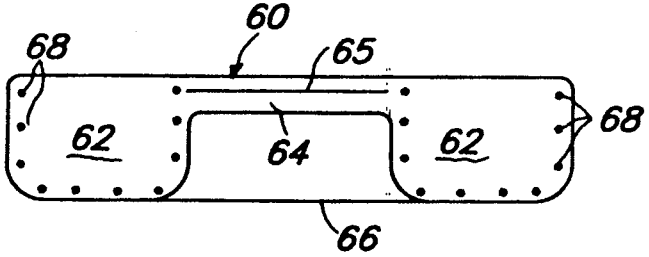
FIG. 6 is a plan view of a connecting yoke of a sixteen-oared pontoon training shell.
Figure 2:
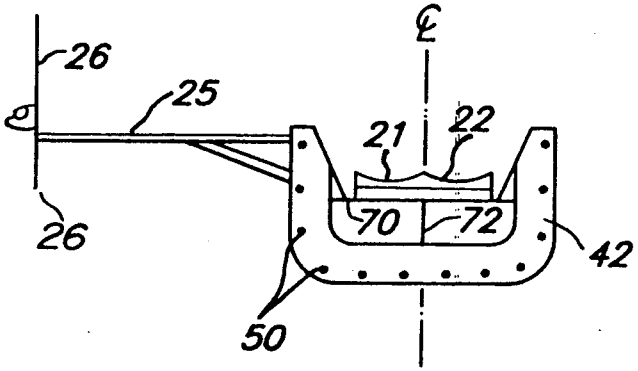
FIG. 2 is an end view of the center section of the modular shell of FIG. 1.
Figure 4:
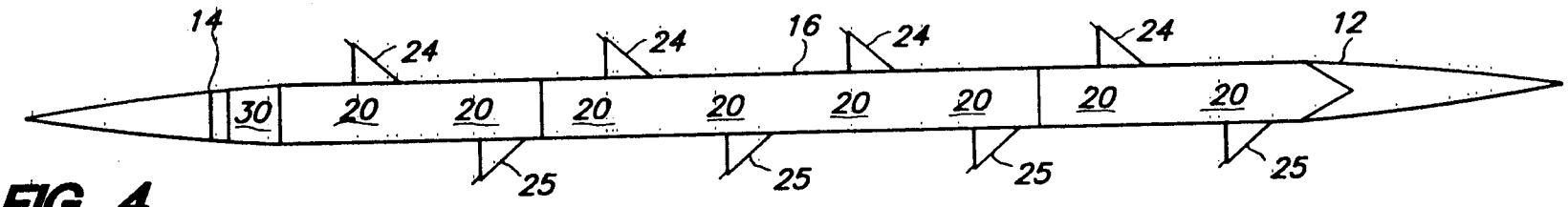
FIG. 4 is a plan view of all three sections connected together to form an eight-oared shell.
Figure 7:
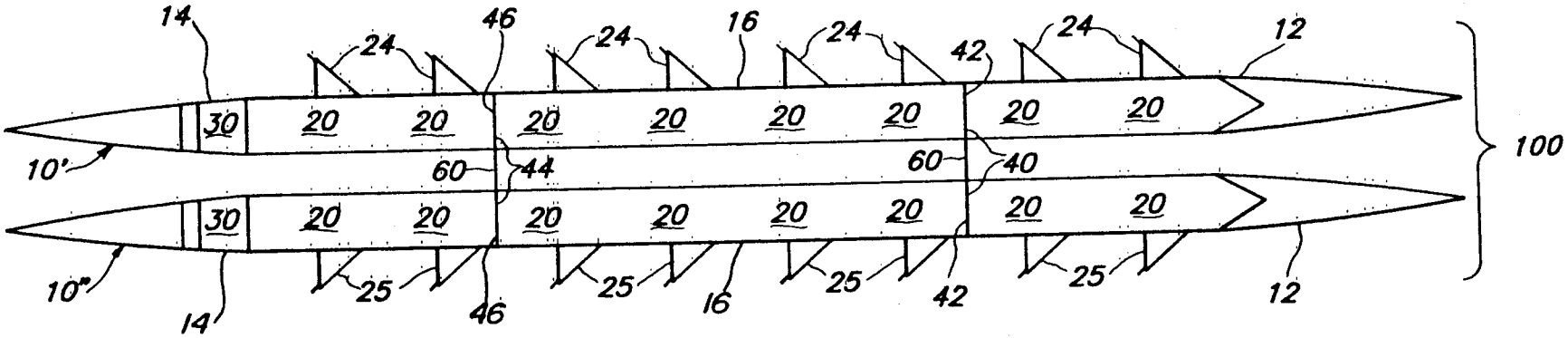
FIG. 7 is a plan view of six sections and two yokes connected together to form a sixteen-oared training shell.

As shown most clearly in FIG. 7, two eight-oared shells 10', 10'' of the present invention (i.e., each shell includes one of each of sections 12, 14, 16 mounted end-to-end as shown in FIG. 4) can be connected side-by-side to create a sixteen-oared pontoon training shell 100. In forming training shell 100, eight port-side outriggers 24 are mounted on the port side of eight-oared shell 10' and eight starboard outriggers 25 are mounted on the starboard side of eight-oared shell 10''. The port and starboard shells 10', 10'' are attached to each other by a pair of connecting yokes 60, shown most clearly in FIG. 6. As shown, each yoke 60 includes a pair of connecting portions 62 attached by an upper connector 64 and a lower reinforcing bar 66. Bolt holes 68 in each connecting portion 62 are arranged to align with the bolt holes 50 in connectors 40, 42, 44, 46. In forming training shell 100, one yoke 60 is placed between the connectors 40, 42 of the bow and center sections of shells 10', 10''; the other yoke 60 is placed between connectors 44, 46 of the center and stern sections of shells 10', 10''. The entire assembly of shell 100 is held rigidly together by stainless steel bolts which, at each joint, hold the connecting portions 62 tightly in place between the respective pair of connectors 40, 42 or 44, 46.

In some embodiments a plank (for a coach or instructor) may be placed between shells 10', 10'', with the ends of the plank resting on support flanges 65 on the facing sides of upper connectors 64. The longitudinal sides of the plank typically will rest on the tops of the adjacent starboard gunwale 78 of center section 10 of port shell 10' and the port gunwale 78 of center section 10 of starboard shell 10'', and will be attached to supports attached to the adjacent sides of the shell hulls.

In use, it will be apparent that the modular shell of the invention may be used to provide either a conventional four-oared shell, a conventional eight-oared shell or a sixteen-oared pontoon training shell. Because the shells are constructed using identical port outriggers, identical starboard outriggers and the rowing station framing assemblies in which the seat deck, keel, keelson and knee at every rowing station are the same, construction, maintenance and repair expenses are greatly reduced. Moreover, a rowing group need purchase only three sections to compete in both four-oared and eight-oared events; or purchase six sections and two connecting yokes to create a sixteen-oared training shell and a combination of four-oared and/or eight-oared shells.

Other embodiments will be within the scope of the following claims.

What is claimed is:

1. A modular rowing shell having a keelson and a seat deck supporting a plurality of seat assemblies:

a bow section including N rowing stations;

a stern section including N rowing stations; and a center section including 2N rowing stations;

the beam of each of said sections at each of said stations being the same, each of said stations including a said seat assembly, a rowing station framing assembly, and either a port outrigger attached to the port side of the respective station or a starboard outrigger attached to the starboard side of the respective station, each of said framing assemblies, said port outriggers, and said starboard outriggers being substantially identical, and each of said framing assemblies including a knee, a portion of said seat deck, and a portion of said keelson.

2. The shell of claim 1 wherein said stern section includes a coxswain's station.

3. The shell of claim 1 wherein the sides of said center section are straight and parallel to each other.

4. The shell of claim 1 wherein the hull of said center section is of constant cross-section along the length thereof.

5. The shell of claim 1 wherein n is two.

6. The shell of claim 1 wherein each of said rowing stations includes a single outrigger attached to a side of said shell, each of said outriggers includes means for supporting an oar for propulsive forces through a pivotal movement about a generally vertical axis spaced outward from the most adjacent side of said shell, and the distances from the respective vertical axis of each of said outriggers to the respective most adjacent side of shell are all the same.

7. The shell of claim 1 wherein at each of said rowing stations, the width of said seat deck is the same, the height of said Keelson is the same, and the knees are the same.

8. The shell of claim 7 wherein the hull of said center section has a constant cross-section throughout its length.

9. A modular rowing shell characterized in that:

it consists essentially of three section connected to each other end-to-end and forming a shell having eight rowing stations, one of said sections being a bow station having two rowing stations, a second of said sections being a center section having four rowing stations, the third of said sections being a stern section having two rowing stations, and said center section being positioned in alignment with and between said bow section and said stern section and being connected to each of said bow section and said stern section;

said center section may be disconnected from said bow section and said stern section, and said bow section connected directly to said stern section in alignment therewith to form a shell having four rowing stations;

the beam and draft of said shell are constant throughout that portion of the length of said eight rowing station shell that extends from the bow end of the forwardmost rowing station to the stern end of the aftmost rowing station;

each of said eight rowing stations includes either a port outrigger assembly attached to the port side of the respective station or a starboard outrigger assembly attached to the starboard side of the respective station, each of said outrigger assemblies is arranged to support an oar for pivotal movement about a vertical axis, all of the port outrigger assemblies are identical, all of the starboard outrigger assemblies are identical, and the distances from the said vertical axis of each of said outriggers to the nearest side of said shell are all the same.

10. The shell of claim 9 wherein said center section is connected to both said bow section and said stern section to form said eight rowing station shell, and said bow section is connected directly to said stern section to form said four rowing station shell.

11. The shell of claim 10 wherein said bow section includes at the aft end thereof a transverse, generally "C" shaped connecting support, a said connecting support is provided at each of the opposite ends of said center section, and said stern section includes a said connecting support at the forward end thereof, said connecting support of said bow section being arranged to abut one connecting support of said center section, and said connecting support of said stern section being arranged to abut the other connecting support of said center section, and including means for bolting abutting connecting supports together.

12. The shell of claim 9 wherein the opposite sides of said shell are parallel throughout the length of said rowing stations.

13. The shell of claim 12 wherein the hull of said center section is of constant cross-section throughout its length.

14. A modular rowing shell comprising two eight rowing station shells according to claim 9 positioned side-by-side and spaced apart from each other, and a pair of longitudinally-spaced transverse yokes, one of said connecting yokes being connected to said shells adjacent the abutting portions of said center sections and stern sections thereof, and the other of said connecting yokes being connected to said shells adjacent the abutting portions of said bow sections and said center sections thereof.

15. The shell of claim 14 wherein each of said yokes is inserted between the adjacent ends of two of said shell sections and is bolted in place therebetween.

* * * * *